US011110699B1

(12) United States Patent
Diaz et al.

(10) Patent No.: US 11,110,699 B1
(45) Date of Patent: Sep. 7, 2021

(54) PRINTED FILM CURING APPARATUS

(71) Applicants: Cesar Diaz, Merced, CA (US); Nazareth Diaz, Merced, CA (US); Alexis Diaz, Merced, CA (US)

(72) Inventors: Cesar Diaz, Merced, CA (US); Nazareth Diaz, Merced, CA (US); Alexis Diaz, Merced, CA (US)

( * ) Notice: Subject to any disclaimer, the term of this patent is extended or adjusted under 35 U.S.C. 154(b) by 0 days.

(21) Appl. No.: 16/896,948

(22) Filed: Jun. 9, 2020

(51) Int. Cl.
*B41F 13/04* (2006.01)
*B41F 23/04* (2006.01)

(52) U.S. Cl.
CPC ..... *B41F 23/0486* (2013.01)

(58) Field of Classification Search
CPC ..... B41F 23/0486
USPC ..... 101/424.1
See application file for complete search history.

(56) References Cited

U.S. PATENT DOCUMENTS 5,729,908 A * 3/1998 Braden ..... A47L 23/205 34/104
5,987,773 A 11/1999 Lipscy
6,440,190 B1 8/2002 Goyetche
7,946,418 B1 5/2011 Cerynik
8,106,279 B1 * 1/2012 Chang ..... F26B 21/006 84/453
D658,314 S 4/2012 Burch
8,328,462 B2 * 12/2012 Beh ..... E01F 9/654 404/9
10,143,354 B2 12/2018 Putnam, Jr.
2003/0115783 A1 * 6/2003 Woosley ..... G09F 27/00 40/584
2007/0157485 A1 * 7/2007 Andrisin, III ..... F26B 21/001 34/201
2008/0271338 A1 * 11/2008 Muir ..... F26B 21/001 34/201
2012/0186096 A1 7/2012 Fox
2018/0243126 A1 8/2018 Porter

* cited by examiner

*Primary Examiner* — Anthony H Nguyen

(57) ABSTRACT

A printed film curing apparatus for accelerating cure time includes a film tube having an open tube top end, a tube sidewall, and an open tube bottom end defining a tube inside. The tube inside receives a roll of freshly printed media. An intake housing is selectively engageable with the tube top end. An intake fan is coupled within the intake housing to draw air through a plurality of intake slots of the intake housing into the tube inside. An exhaust housing is selectively engageable with the tube bottom end. An exhaust fan is coupled within the exhaust housing to draw air from the tube inside and push it out of a plurality of exhaust apertures of the exhaust housing. A control unit has a control panel, a microprocessor, and a power supply to operate the intake fan and the exhaust fan.

12 Claims, 6 Drawing Sheets

PRINTED FILM CURING APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to drying devices and more particularly pertains to a new drying device for accelerating cure time.

(2) Description of Related Art Including Information Disclosed Under 37 CFR 1.97 and 1.98

The prior art relates to drying devices for a variety of applications. Existing devices are often suited for drying a particular object such as shoes and paintbrushes. More general drying devices are often oven-like devices and utilize heat. What is needed, and what the present invention provides, is a drying device to receive printed media such as vinyl film and create airflow and improve ventilation to accelerate curing time.

BRIEF SUMMARY OF THE INVENTION

An embodiment of the disclosure meets the needs presented above by generally comprising a film tube having an open tube top end, a tube sidewall, and an open tube bottom end defining a tube inside. The tube inside is configured to receive a roll of freshly printed media. An intake housing is coupled to the film tube and is selectively engageable with the tube top end. An intake fan is coupled within the intake housing to draw air through a plurality of intake slots of the intake housing into the tube inside. An exhaust housing is coupled to the film tube and is selectively engageable with the tube bottom end. An exhaust fan is coupled within the exhaust housing to draw air from the tube inside and push it out of a plurality of exhaust apertures of the exhaust housing. A control unit is coupled to the film tube and has a control panel, a microprocessor, and a power supply. The control unit is in operational communication with the intake fan and the exhaust fan.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
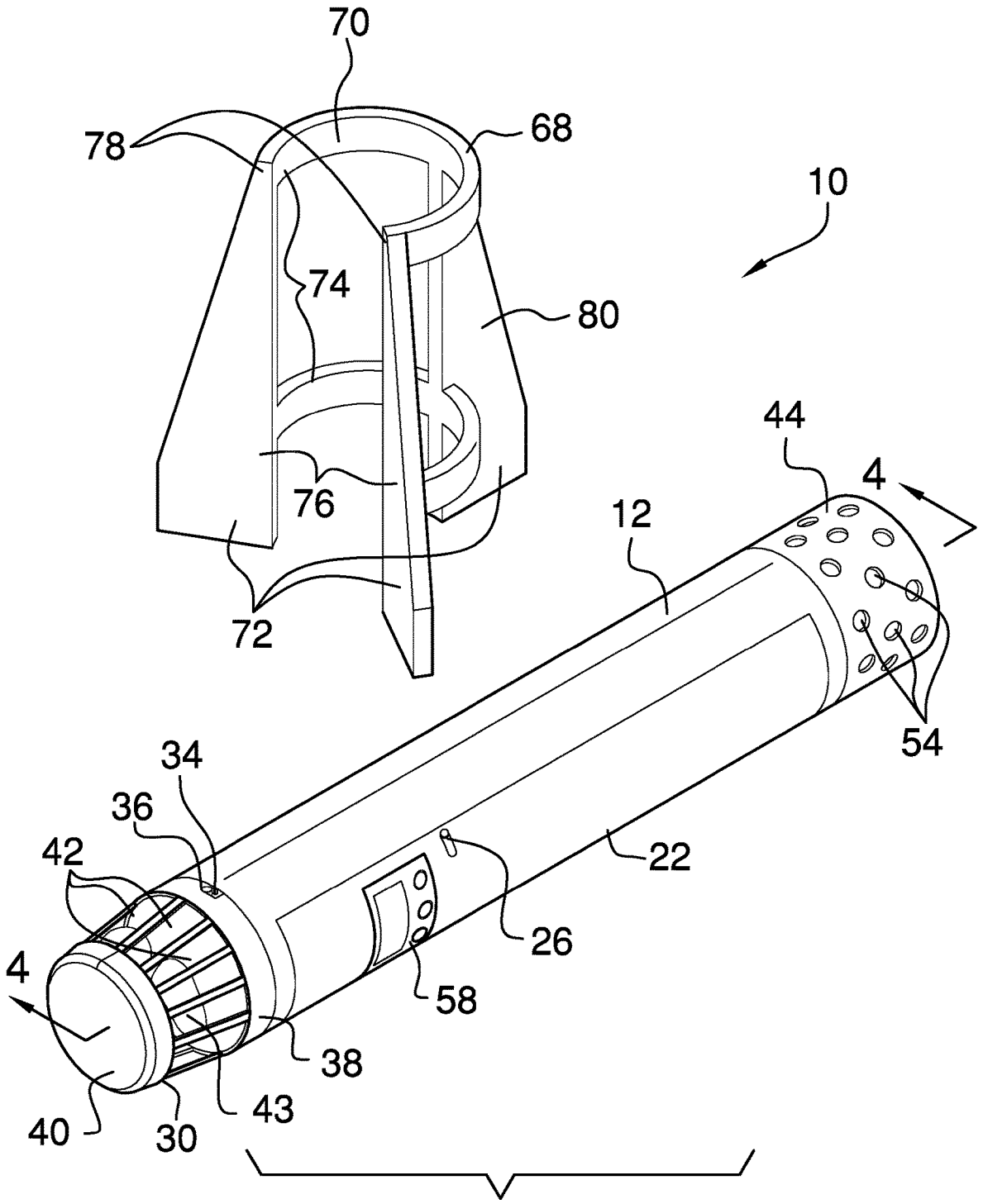
FIG. 1 is an isometric view of a printed film curing apparatus according to an embodiment of the disclosure.
Figure 2:
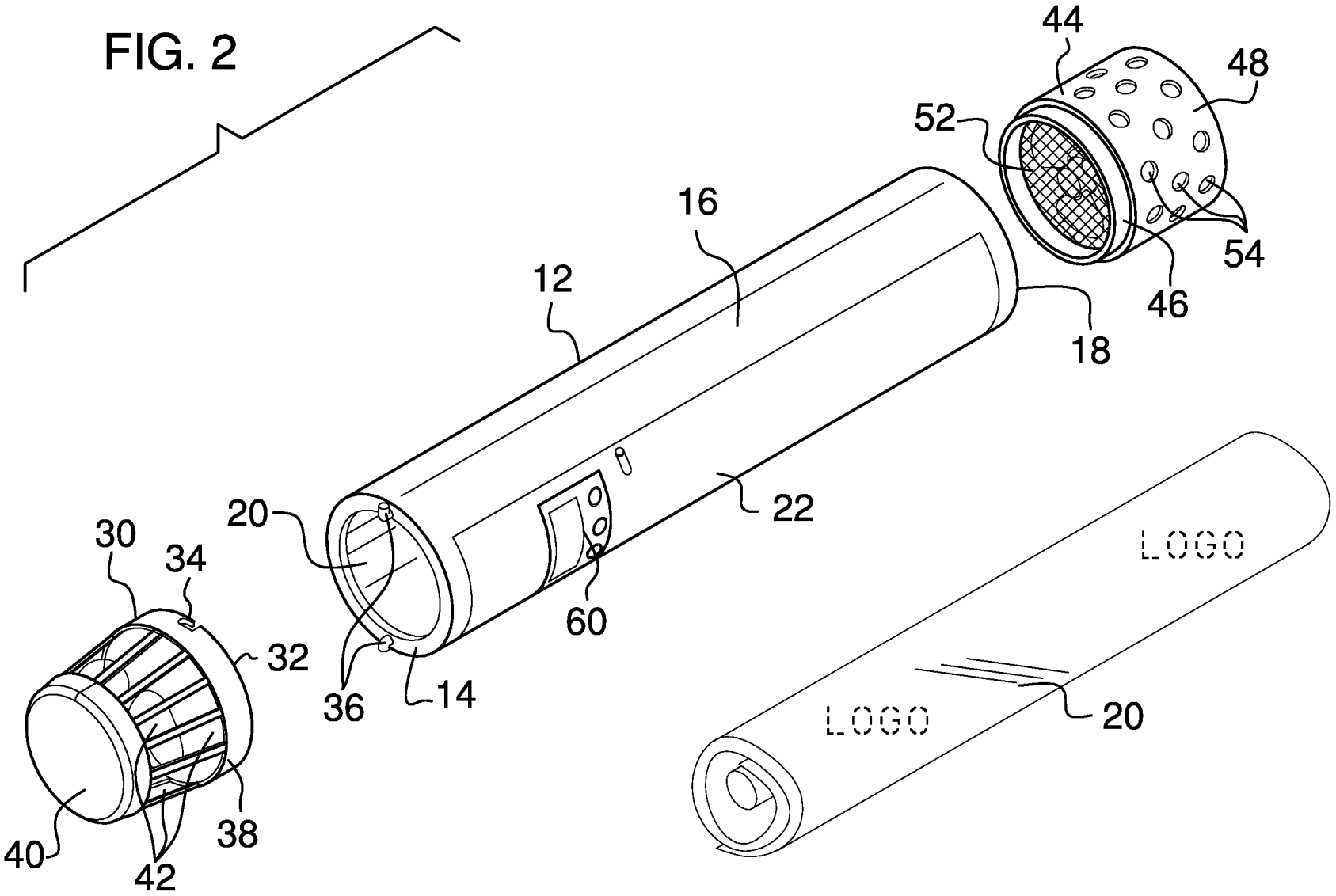
FIG. 2 is an isometric exploded view of an embodiment of the disclosure.
Figure 3:
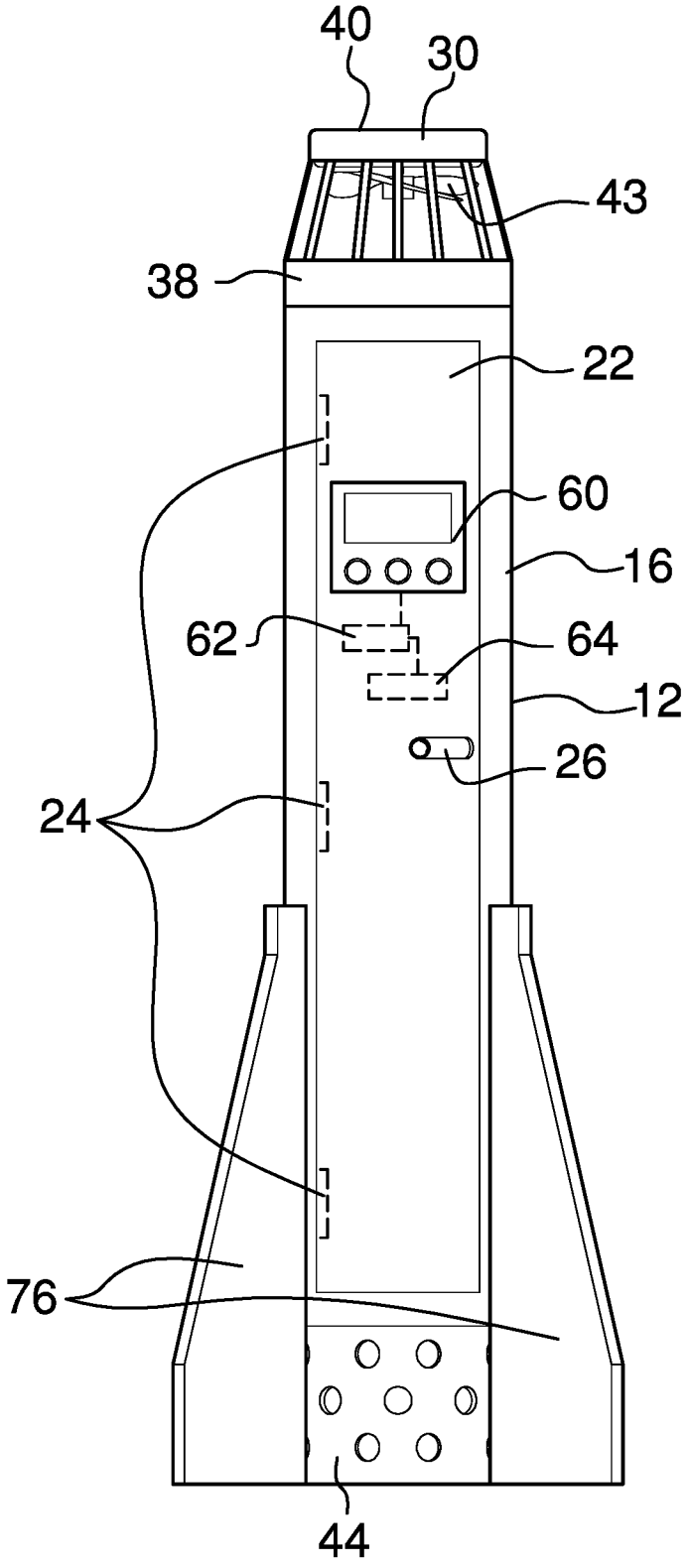
FIG. 3 is a front elevation view of an embodiment of the disclosure.
Figure 4:
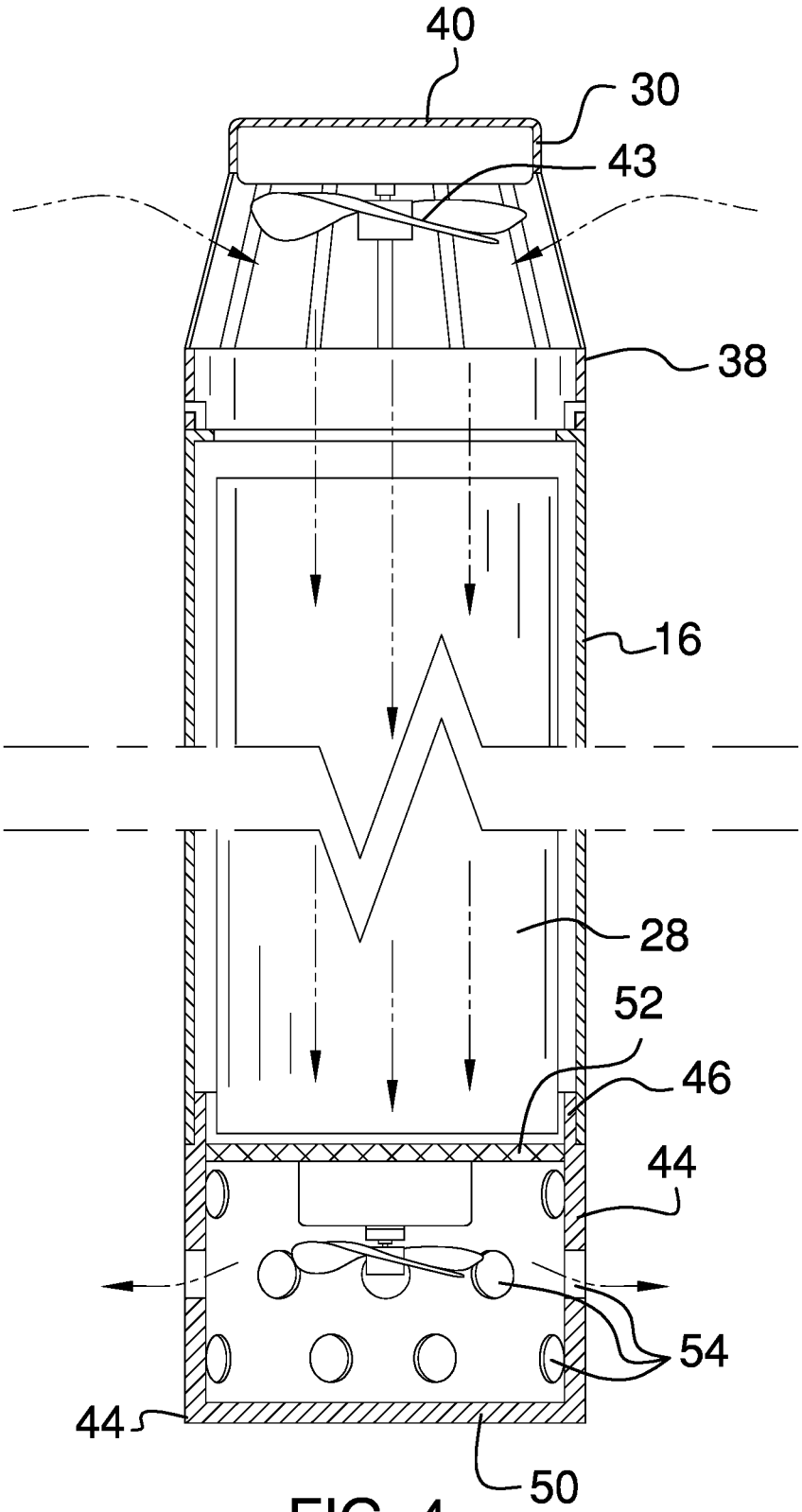
FIG. 4 is a cross-sectional view of an embodiment of the disclosure along the line 4-4 of FIG. 1.
Figure 5:
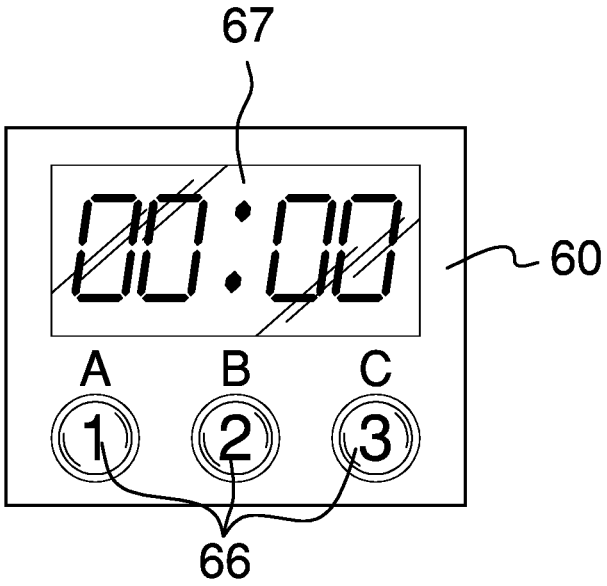
FIG. 5 is a detail view of an embodiment of the disclosure.
Figure 6:
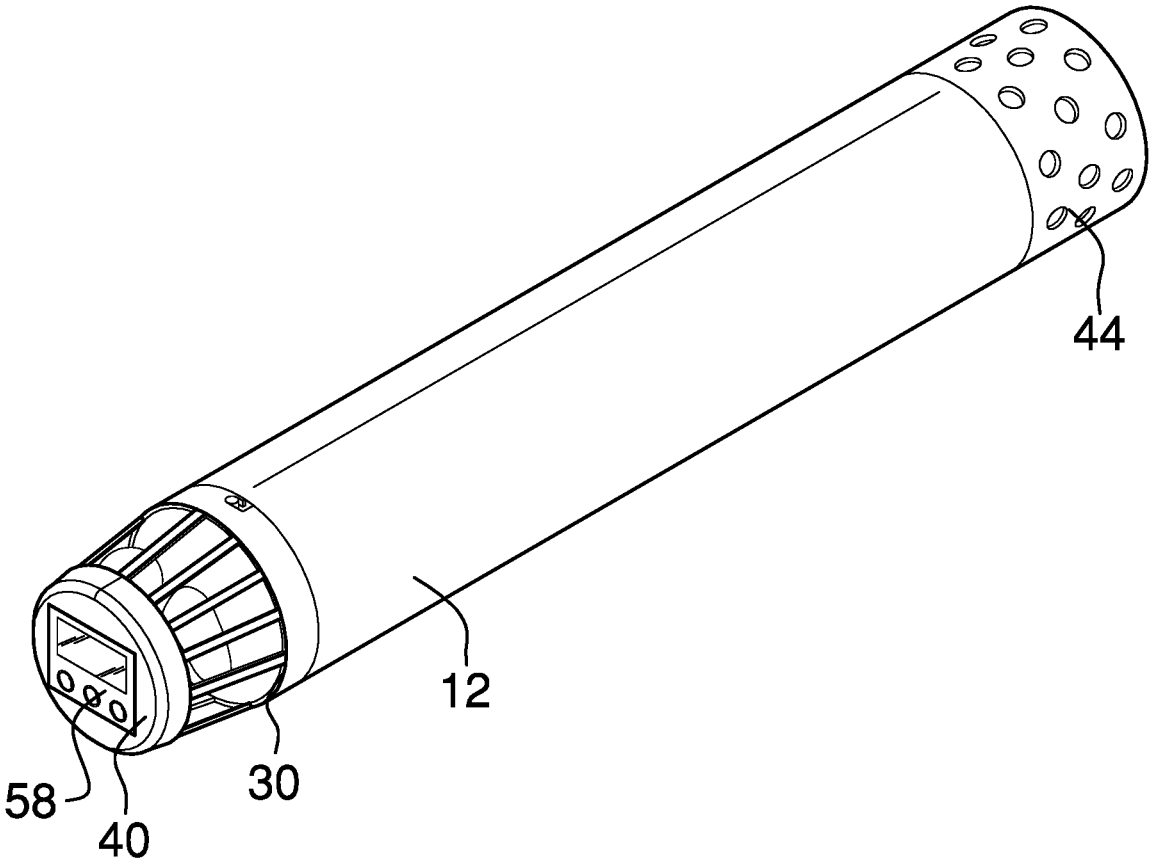
FIG. 6 is an isometric view of an embodiment of the disclosure.

With reference now to the drawings, and in particular to FIGS. 1 through 6 thereof, a new drying device embodying the principles and concepts of an embodiment of the disclosure and generally designated by the reference numeral 10 will be described.

As best illustrated in FIGS. 1 through 6, the printed film curing apparatus 10 generally comprises a film tube 12 having an open tube top end 14, a tube sidewall 16, and an open tube bottom end 18 defining a tube inside 20. The film tube 12 may have an access door 22 extending through the tube sidewall 16. The access door 22 has a plurality of hinges 24 coupled to the tube sidewall 16 and a slide lock 26 to selectively engage the tube sidewall 16. The access door 22 matches the contour of the tube sidewall 16. The tube inside 20 is configured to receive a roll of freshly printed media 28 through either the access door 22, the tube top end 14, or the tube bottom end 18. The film tube 12 is dimensioned according to the size of printed media 28 to be received and may correlate to standard lengths such as, but not limited to, 40 inches, 56 inches, 66 inches, or 110 inches. The printed media 28 may be, but is not limited to, solvent and eco-solvent printed vinyl for vehicle wraps.

An intake housing 30 is coupled to the film tube 12. An intake bottom edge 32 of the intake housing may have a pair of engagement slots 34 to selectively receive a pair of engagement arms 36 of the tube top end 14. The pair of engagement slots 34 twist on the pair of engagement arms 36 to selectively engage the intake housing 30 onto the tube top end 14. The intake housing 30 has an intake sidewall 38 and an intake top side 40. A plurality of intake slots 42 extends through the intake sidewall 38. The intake housing 30 may taper thinner from the intake bottom edge 32 to the intake top side 40. An intake fan 43 is coupled within the intake housing 30 to the intake top side 40. The intake fan 43 draws air through the plurality of intake slots 42 into the tube inside 20.

An exhaust housing 44 is coupled to the film tube 12. The exhaust housing 44 may have an engagement lip 46, an exhaust sidewall 48, an exhaust bottom side 50, and a filter 52. The filter 52 is coupled to the exhaust sidewall 48 parallel to the exhaust bottom side 50 and may be selectively removable to be cleaned or replaced. The engagement lip 46 selectively engages the tube bottom end 18 of the film tube. A plurality of exhaust apertures 54 extends through the exhaust sidewall 48. An exhaust fan 56 is coupled within the exhaust housing 44. The exhaust fan 56 may be coupled to the filter 52 to draw air from the tube inside 20 through the filter 52 and push it out of the plurality of exhaust apertures 54 of the exhaust housing.

A control unit 58 is coupled to the film tube 12. The control unit 58 is coupled to the access door 22 and includes a control panel 60, a microprocessor 62, and a power supply 64. The power supply 64 may be an AC or DC power adaptor suited for 12v, 110v, or 220*v* outlets. When the access door 22 is not present the control unit 58 may be coupled to the intake top side 40. The control unit 58 is in operational communication with the intake fan 43 and the exhaust fan 56. The control panel 60 has a plurality of buttons 66 and a display screen 67 to operate the intake fan 43 and the exhaust fan 56 for manual or preset durations of time depending on the size and material of the printed media 28.

A stabilizer 68 has a stabilizer body 70 and a plurality of stabilizer wings 72 coupled to the stabilizer body 70. The stabilizer body 70 is selectively engageable with the film tube 12 and the exhaust housing 44 to maintain the apparatus 10 in an upright position. The stabilizer body 70 may include a pair of arc-shaped clips 74. The plurality of stabilizer wings 72 may include a pair of outer wings 76 coupled to a pair of distal ends 78 of each of the arc-shaped clips and a medial wing 80 centrally coupled to each arc-shaped clip 74.

In use, the printed media 28 is placed within the tube inside 20 and the control panel 60 is manipulated to operate the intake fan 43 and the exhaust fan 56 to draw air through the tube inside 20. The off-gassing of the printed media 28 is thus accelerated and the total cure time is greatly reduced before application.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A printed film curing apparatus comprising:

a film tube having an open tube top end, a tube sidewall, and an open tube bottom end defining a tube inside, the tube inside being configured to receive a roll of freshly printed media;

an intake housing coupled to the film tube, the intake housing being selectively engageable with the tube top end;

an intake fan coupled within the intake housing, the intake fan drawing air through a plurality of intake slots of the intake housing into the tube inside;

an exhaust housing coupled to the film tube, the exhaust housing being selectively engageable with the tube bottom end;

an exhaust fan coupled within the exhaust housing, the exhaust fan drawing air from the tube inside and pushing it out of a plurality of exhaust apertures of the exhaust housing; and a control unit coupled to the film tube, the control unit having a control panel, a microprocessor, and a power supply, the control unit being in operational communication with the intake fan and the exhaust fan.

2. The printed film curing apparatus of claim 1 further comprising the tube top end having a pair of engagement arms; an intake bottom edge of the intake housing having pair of engagement slots to selectively receive the pair of engagement arms.

3. The printed film curing apparatus of claim 1 further comprising the intake housing having an intake sidewall and an intake top side, the plurality of intake slots extending through the intake sidewall, the intake fan being coupled to the intake top side.

4. The printed film curing apparatus of claim 1 further comprising the film tube having an access door extending through the tube sidewall.

5. The printed film curing apparatus of claim 4 further comprising the access door having a plurality of hinges coupled to the tube sidewall and a slide lock to selectively engage the tube sidewall.

6. The printed film curing apparatus of claim 4 further comprising the control unit being coupled to the access door.

7. The printed film curing apparatus of claim 1 further comprising the control panel having a plurality of buttons to operate the intake fan and the exhaust fan for manual or preset durations of time.

8. The printed film curing apparatus of claim 1 further comprising the exhaust housing having an engagement lip, an exhaust sidewall, an exhaust bottom side, and a filter, the filter being coupled to the exhaust sidewall parallel to the exhaust bottom side, the engagement lip selectively engaging the tube bottom end of the film tube, the plurality of exhaust apertures extending through the exhaust sidewall; the exhaust fan being coupled to the filter.

9. The printed film curing apparatus of claim 1 further comprising a stabilizer, the stabilizer being selectively engageable with the film tube and the exhaust housing to maintain the apparatus in an upright position.

10. The printed film curing apparatus of claim 9 further comprising the stabilizer having a stabilizer body and a plurality of stabilizer wings coupled to the stabilizer body, the stabilizer body being selectively engageable with the film tube and the exhaust housing.

11. The printed film curing apparatus of claim 10 further comprising the stabilizer body including a pair of arc-shaped clips, the plurality of stabilizer wings including a pair of outer wings coupled to a pair of distal ends of each of the arc-shaped clips and a medial wing centrally coupled to each arc-shaped clip.

12. A printed film curing apparatus comprising:

a film tube having an open tube top end, a tube sidewall, and an open tube bottom end defining a tube inside, the film tube having an access door extending through the tube sidewall, the access door having a plurality of hinges coupled to the tube sidewall and a slide lock to selectively engage the tube sidewall, the tube inside being configured to receive a roll of freshly printed media through the access door, the tube top end having a pair of engagement arms;

an intake housing coupled to the film tube, an intake bottom edge of the intake housing having pair of engagement slots to selectively receive the pair of engagement arms, the intake housing having an intake sidewall and an intake top side, a plurality of intake slots extending through the intake sidewall, the intake housing being selectively engageable with the tube top end;

an intake fan coupled within the intake housing, the intake fan being coupled to the intake top side the intake fan drawing air through the plurality of intake slots into the tube inside;

an exhaust housing coupled to the film tube, the exhaust housing having an engagement lip, an exhaust sidewall, an exhaust bottom side, and a filter, the filter being coupled to the exhaust sidewall parallel to the exhaust bottom side, the engagement lip selectively engaging the tube bottom end of the film tube, a plurality of exhaust apertures extending through the exhaust sidewall;

an exhaust fan coupled within the exhaust housing, the exhaust fan being coupled to the filter and drawing air from the tube inside through the filter and pushing it out of the plurality of exhaust apertures of the exhaust housing;

a control unit coupled to the film tube, the control unit being coupled to the access door and having a control panel, a microprocessor, and a power supply, the control unit being in operational communication with the intake fan and the exhaust fan, the control panel having a plurality of buttons to operate the intake fan and the exhaust fan for manual or preset durations of time; and a stabilizer, the stabilizer having a stabilizer body and a plurality of stabilizer wings coupled to the stabilizer body, the stabilizer body being selectively engageable with the film tube and the exhaust housing to maintain the apparatus in an upright position, the stabilizer body including a pair of arc-shaped clips, the plurality of stabilizer wings including a pair of outer wings coupled to a pair of distal ends of each of the arc-shaped clips and a medial wing centrally coupled to each arc-shaped clip.

* * * * *